United States Patent [19]

Richards

[11] Patent Number: 5,069,190

[45] Date of Patent: Dec. 3, 1991

[54] FUEL TREATMENT METHODS, COMPOSITIONS AND DEVICES

[76] Inventor: Charlie W. Richards, 324 Mineral Hill, Las Vegas, N. Mex. 87701

[21] Appl. No.: 693,620

[22] Filed: Apr. 30, 1991

[51] Int. Cl.[5] ..... F02M 33/00

[52] U.S. Cl. ..... 123/538; 420/501; 420/505

[58] Field of Search ..... 123/536, 538, 3, 1 A; 420/501, 503, 505

[56] References Cited

U.S. PATENT DOCUMENTS

| | | | |
|---|---|---|---|
| 2,221,285 | 11/1940 | Hensel et al. | 420/501 |
| 2,947,623 | 8/1960 | Lincoln | 420/501 |
| 3,597,668 | 10/1969 | Yoshimine | 123/530 |
| 3,997,651 | 12/1976 | Bocciarelli | 420/501 |
| 4,050,426 | 9/1977 | Sanderson | 123/538 |
| 4,385,892 | 5/1983 | Sato et al. | 420/501 |
| 4,429,665 | 2/1984 | Brown | 123/3 |
| 4,539,041 | 9/1985 | Figlarz et al. | 420/501 |
| 4,715,325 | 12/1987 | Walker | 123/538 |
| 4,930,483 | 6/1990 | Jones | 123/538 |

FOREIGN PATENT DOCUMENTS 1-263237 10/1989 Japan .

*Primary Examiner*—Andrew M. Dolinar
*Assistant Examiner*—M. Macy
*Attorney, Agent, or Firm*—Kenneth E. Darnell

[57] ABSTRACT

The invention encompasses methods, compositions of matter and devices used with fuel combustion apparatus for treating fuels prior to combustion by flowing such fuels into intimate contact with one of a variety of metal alloys formed from refractory ores including platinum group metals and rare earths. At least one of the metal alloys of the invention is contained within a housing through which the fuel is caused to flow, thereby contacting the fuel with the alloy with a resulting decrease in pollutants and increased fuel utilization on combustion of the fuel. Fuels useful with the invention generally include hydrocarbon fuels such as diesel, gasolines, propane, butane, natural gas, etc., which are burned not only in internal combustion engines but also in other commonly used combustion apparatus.

19 Claims, 1 Drawing Sheet

FIG. 1
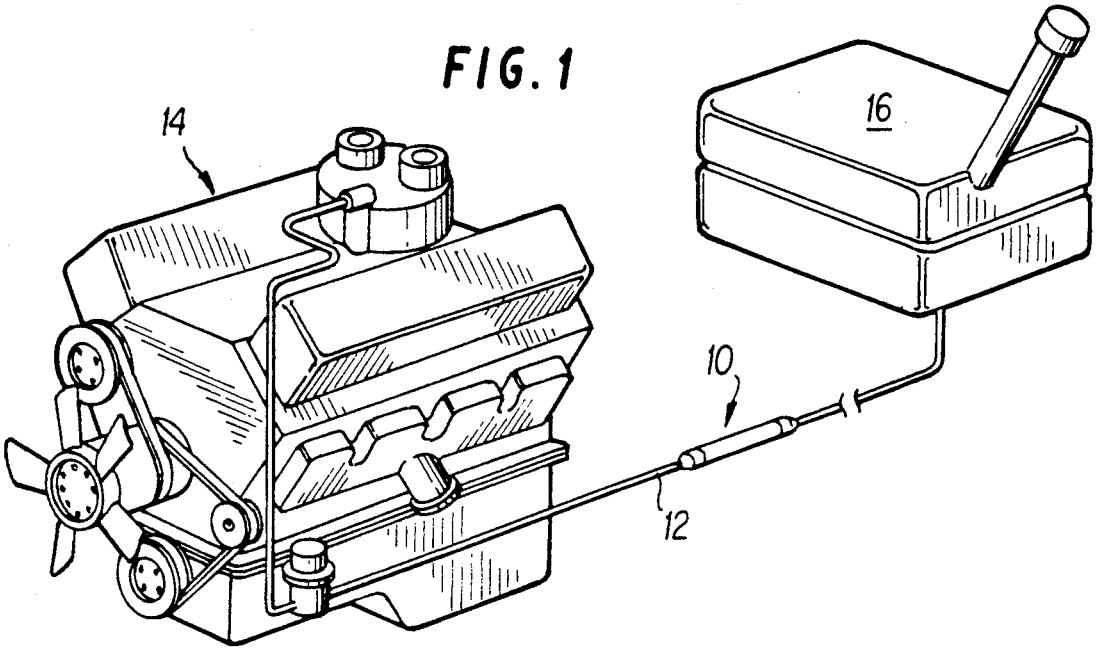
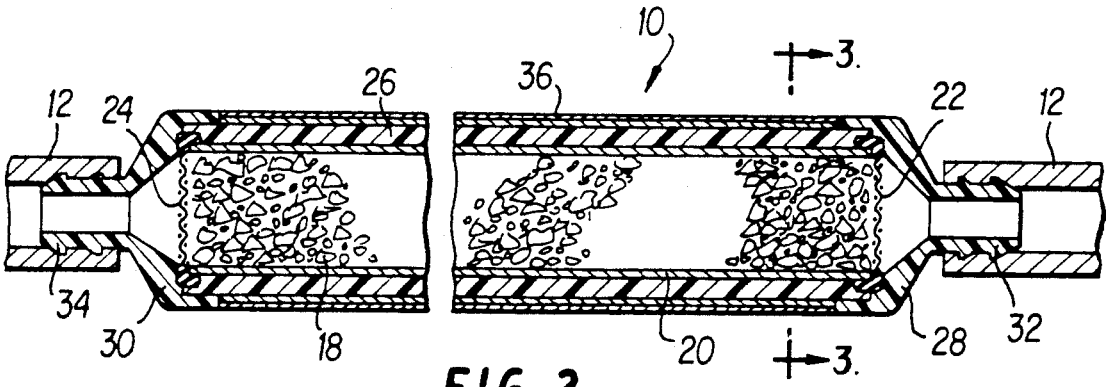
FIG. 2
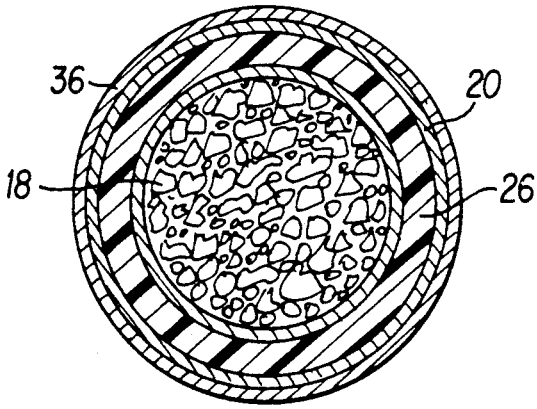
FIG. 3

FUEL TREATMENT METHODS, COMPOSITIONS AND DEVICES

BACKGROUND OF THE INVENTION

1. Field of the Invention

The invention relates to technology capable of increasing combustion efficiency of common hydrocarbon fuels and the like in various combustion processes and particularly relates to methods, compositions of matter and devices useful for increasing fuel utilization and reducing pollutants in the combustion of such fuels in internal combustion engines and the like.

2. Description of the Prior Art

The prior art is replete with teachings which purport to treat fuel prior to combustion in internal combustion engines or the like by means of various treatments ranging from electrostatic charging to contact with metal alloys. As an example, Yoshimine, in U.S. Pat. No. 3,597,668, electrostatically charges a liquid fuel upstream of the carburetor of an internal combustion engine with apparent improvement in fuel efficiency. Sanderson, in U.S. Pat. No. 4,050,426, provides an apparatus for treating fuel in the fuel line leading to the carburetor of an internal combustion engine. The Sanderson apparatus comprises an outer casing of magnetic material and an inner casing of non-magnetic material positioned within the outer casing and further with an elongated magnet received within the inner casing with the poles of the magnet being oriented in a particular manner. Sanderson also reports an apparent increase in fuel efficiency. In U.S. Pat. No. 4,715,325, Walker passes a fuel into contact with a crystalline alloy prior to burning of the fuel in an internal combustion engine for the purpose of reducing pollution and increasing engine performance. Walker discloses an alloy consisting of copper zinc, nickel, lead and small amounts of iron, antimony and manganese. Walker theorizes that hydrocarbons flowing in contact with the metal alloy are altered through polarization of the hydrocarbon molecules, a change in the electrostatic charge of the hydrocarbon molecules being apparently effected. While improved combustion efficiencies have been reported through use of devices such as those referred to above, explanation as to the causes for such improvements have varied with no presently known explanation being apparently agreed to in scientific circles. It has been suggested that the flowing of fuel in contact with a crystalline alloy causes an electromotive potential to be imposed on the molecules of the fuel. It has also been suggested in the prior art that particular alloys produce particular effects and thus efficiencies.

Accordingly, a need exists in the art for technology capable of improving fuel efficiency in the combustion of fuels in internal combustion engines and similar combustion apparatus while also reducing emissions from the burning of such fuels. As such, the present invention provides methods, compositions of matter and apparatus intended to meet these long felt needs in the art.

SUMMARY OF THE INVENTION

The invention provides compositions of matter and particularly complex microcrystalline metal alloys which when contacted with hydrocarbon fuels such as diesel fuel, gasolines, and the like, cause the fuels to be more efficiently combusted in internal combustion engines and other combustion apparatus. The several compositions of matter of the invention are formed from refractory ores containing platinum group metals and rare earths. The invention further provides methods for treating the refractory ores and combining treatment products with metals such as silver to produce the complex microcrystalline metal alloys useful as compositions of matter according to the invention and useful also as active materials within devices placed in the fuel lines of internal combustion engines and other combustion apparatus for treatment of fuel prior to combustion. The invention further encompasses methodology for operating internal combustion engines and other combustion apparatus using fuels treated according to the teachings of the invention.

The technology represented by the various methodology, compositions of matter and apparatus configured according to the invention is capable not only of increasing combustion efficiency of fuels treated according to the invention but also is capable of reducing noxious emissions resulting from prior art combustion processes. Fuel treatment according to the invention involves the utilization of approximately one ounce of a "mossy" form of the present metal alloys in a device placed in the fuel line of an internal combustion engine or the like such that fuel flows into intimate contact with the metal alloy prior to combustion. The metal alloys of the invention are produced in this "mossy" or prill form so that the alloy has maximum surface area with which to contact the fuel passing through a device containing the metal alloy. Due to this large surface area of the alloy, virtually all molecules of the fuel come within sufficient proximity to the alloy to cause the benefits of the invention. The disposition of these literally thousands of particles, pieces or prills of metal alloy within a treating device according to the invention causes turbulence within the fuel flow to more completely treat the fuel by bringing the fuel into more intimate contact with the metal alloy. This turbulence also acts to increase fuel residence time within the alloy-containing devices of the invention to still further increase the opportunities for fuel/alloy interaction.

Accordingly, it is a primary object of the invention to provide methods, compositions of matter and apparatus useful with fuel combustion apparatus for treating fuels prior to combustion, thereby to increase combustion efficiency of the fuels while reducing pollutants commonly encountered in prior art combustion processes.

It is another object of the invention to provide methodology for producing metal alloys according to the invention, which alloys are useful in the treatment of fuel to improve fuel combustion within internal combustion engines and other combustion apparatus.

It is a further object of the invention to provide compositions of matter including metal alloys formed of silver, platinum group metals and rare earths, the metal alloys acting to treat fuel passed in intimate contact therewith prior to combustion in internal combustion engines and other combustion apparatus.

Further objects and advantages of the invention will become more readily apparent in light of the following detailed description of the preferred embodiments.

BRIEF DESCRIPTION OF THE DRAWINGS

FIG. 1 is an idealized perspective illustrating an internal combustion engine conventionally joined to a fuel supply but with a device configured according to the invention interposed between the internal combustion engine and the fuel supply;

FIG. 2 is a side elevational view in partial section of a preferred embodiment of a device which would be interposed between an internal combustion engine and a fuel supply for treatment of fuel to increase combustion efficiency; and, FIG. 3 is a sectional view taken along lines 3—3 of FIG. 2.

DESCRIPTION OF THE PREFERRED EMBODIMENTS

The disclosure of U.S. Pat. No. 4,715,325 to Walker is incorporated hereinto by reference.

Compositions of matter comprising metal alloys including the platinum group metals in a combined crystalline alloy complex with gold, silver and rare earth metals are produced according to the invention from raw ores which also contain isotopes of these metals which will be complexed within the resulting alloys. These compositions of matter can be used not only with the methodology and devices of the present invention but also with other methodology and devices such as are known in the prior art and which may come to be known and which are illustrated, as examples, by the methodology and apparatus of U.S. Pat. No. 4,715,325 inter alia.

The compositions of matter of the present invention are produced in a first step with the concentration of ore collected in San Miguel County, New Mexico, this ore containing inter alia precious metals which can include gold, platinum, palladium, rhodium, osmium, ruthenium, iridium, and silver. Further, the ore contains small amounts of rare earths such as one or more of the following elements including lanthanum, cerium, praseodymium, samarium, ytterbium, yttrium, neodymium, gadolinium, thorium and dysprosium. The ore is concentrated such as with a Vardax reverse spiral concentrator as is conventional in the art with the concentrated ore being analyzed to include elements other than as noted above including titanium, potassium, uranium and vanadium. In concentration of the ore, hydrophobic values are retained. A concentrating cut should be made so as to retain garnate present in the ore. A centrifuge can conveniently be used for concentrating the ore in order to retain microscopic and hydrophobic values. Once concentrated, the ore is dried and processed in a ball mill to a 200 mesh or finer gain size. The ore is then saturated with sulfuric acid of approximately 25% to 50% solution in water for at least four hours. The sulfuric acid solution should cover the ore and be sufficiently concentrated to maintain action for at least two hours.

Separately, a reagent is formed by the dissolution of several ounces of pure silver in a solution of 25% nitric acid in water. The silver is precipitated as silver chloride by adding hydrochloric acid to the silver nitrate solution as is customary in the refining arts. A separate reagent is then prepared by the dissolution of silver in nitric acid followed by electrowaning in a Thumb cell as is conventional to yield small silver crystals.

After draining of the unwashed ore which has been soaked in the sulfuric acid solution, three parts of the unwashed drained ore are mixed with one part soda ash, one quarter part lime, one part borax and one-eighth part caustic soda. The mixture is then stirred well with substantial heat being liberated.

Secondly, one part of unwashed drained silver chloride from above is combined with one-eighth part caustic soda, one-eighth part lime, one-half part soda ash and one part borax, the mixture being mixed together with substantial heat release.

The products of the two heat-evolving mixtures are combined with care in consideration of the heat liberated in these processes as well as the fumes generated. Vessels involved in this admixture must be resistant to acid and alkali. The mixture thus formed is combined with the product of four parts borax, one-fourth part whole wheat flour, one part silver crystals and two parts crushed borax glass. The mixture thus produced is added to a preheated silica carbide crucible at 500° F. to 800° F. to half fill the crucible. The charge will liquefy and then crust over. The charge is capped with two parts borax, one part borax glass and one-fourth part silver crystals and placed in a 1000° F. gas fired blast furnace. The charge is held at 1000° F. until the charge reliquefies and then becomes dry. Heat is then increased to 2000° F. and held until the melt is quiet. The melt is then poured into a suitably sized iron mold and allowed to cool completely. Slag is removed and crushed in a jaw mill followed by passage through a roller for removal of any particles of metal which may have been caught in the flux. The slag will also contain titanium which was present in the ore and which can be collected through magnetic separation.

A cold silica carbide crucible is charged one-half full with a mixture of five parts borax, two parts soda ash, one part ammonium chloride, one-half part caustic soda, one-quarter part lime, one-quarter part urea, one-half part borax glass and one-eighth part whole wheat flour. The metal contained from the poured melt and from the slag crushing step is added to the crucible and fired in a blast furnace at 1900° F. to 2000° F. until the metal is quiet. This step removes base metals.

The process thus described produces complex microcrystalline combined metal alloys comprising platinum group metals complexed with gold, silver and rare earth metals present in the original ore. Isotopes of these metals found in the original ore are also complexed within the metal alloys. It is to be understood that osmium and ruthenium, while volatile metals, are stabilized in the present metal alloys due to the basic flux process used to produce the present metal alloys.

For maximum performance, metal alloys produced according to the invention for use in fuel treatment devices should contain approximately 60% to 90% silver. The alloy produced according to the foregoing procedure must then be assayed for silver content with any additional silver being necessary being added in a melt with the flux used in charging of the cold silica carbide crucible as aforesaid.

Preferred metal alloys according to the invention comprise approximately 60% to 90% silver with quantities of precious metals selected from the group consisting of gold, platinum, palladium, osmium, rhodium, iridium and ruthenium as well as rare earths selected from the group consisting of lanthanum, cerium, praseodymium, samarium, ytterbium, yttrium, neodymium, gadolinium, thorium and dysprosium. The preferred alloys also contain approximately 1% to 2.5% iron and 1% combined copper, nickel and silica. The quantities of the rare earths present in the alloy are typically 1% to 5%, those rare earths present in the alloy having been present in the original ore. Accordingly, at least one of the rare earths is taken to be present in the alloy with two or more of the rare earths being typically present. The precious metals in addition to silver which are present in the present metal alloys include isotopes thereof and are present in quantities of less than 10%. One or more of the precious metals are present in the present metal alloys with the inclusion of at least one of the platinum group metals being critical to use of the present metal alloys according to practice of the invention.

According to further teachings of the invention, the metal alloys thus described above are contacted with fuel which is to be combusted in an internal combustion engine, combustion efficiency of the fuel being greatly increased with a corresponding reduction of hydrocarbon and carbon monoxide emissions. While explanation as to the mechanism by which combustion efficiency is thus improved is not necessary, it is theorized that one or more mechanisms may operate. In particular, a catalytic effect may be derived due to the presence of the platinum group metals. It is also possible that the combined metals exhibit a hyper magnetic effect in their natural state. Another possible mechanism involves the magnetic properties of the rare earths themselves. Still further, a hydrostatic effect which changes the valence of fuel molecules to allow the molecules to combine with oxygen on a molecular level to cause complete burning of the fuel may also operate in the present situation.

Referring now to the drawings, and particularly to FIG. 1, a fuel treatment device 10 configured according to the present invention can be seen to be located in fuel line 12 which connects internal combustion engine 14 and a fuel source such as a gasoline tank 16. The device 10 should be mounted as close to the carburetor of the engine 14 as is practical and should be located as far as possible from the coil, plug wire, distributor or any electrical source. In its simplest form, the present metal alloys of the invention are disposed within the fuel treatment device 10 in the form of "metal mossy" which is produced by melting of the alloy and then pouring the molten alloy into cold water with stirring. Shot of irregular shape and having small irregularities on the surfaces and edges thereof are thus formed. This metal mossy or shot 18 can be seen in FIGS. 2 and 3 to be contained within a copper tube 20 sealed with suitable mon-magnetic and inert plastic screens 22 and 24 at each end of the tube 20. The assembly thus formed is then placed within a plastic sheath 26 with copper caps 28 and 30 being fitted to the ends of the assembly. Nipples 32 and 34 are received within the caps 28 and 30 respectively for splicing of the device 10 in the fuel line 12. While the device 10 is seen to be disposed in the fuel line 12 of an internal combustion engine 14, it is to be understood that other hydrocarbon fueled devices such as turbines, blast furnaces, propane fired appliances, etc. can also be employed according to the teachings of the invention.

The device 10 is preferably wrapped with a foil and paper wrapping 36 which is intended to electrically shield the alloy shot 18 as well as the copper components of the device 10. The wrapping 36 also acts as electrical insulation and as a heat sink to preheat fuel passing through the device 10, thereby increasing combustion efficiency.

For best results, a neoprene or copper conduit (not shown) is placed in the fuel line 12 between the device 10 and the carburetor or fuel injector (not shown) of the engine 14. In operation, an excess of 0.5% to 3.5% oxygen in the exhaust of the engine 14 is desirable in order that the device 10 provides optimal results. The quantity of oxygen in the exhaust is used as a basis for adjustment of the carburetor or adjustment of fuel to the device 10 relative to fuel rate and engine size.

Composition of the alloys of the invention provides best results with 60% to 90% by weight of silver; 5% to 10% by weight of gold; 1% to 2.5% by weight of base metals; 1% to 5% by weight of rare earths and 1% to 2.5% by weight of iron.

It is to be understood that the present alloy compositions may be used in devices other than that described herein but will also find utility in those other devices of the prior art which utilize various metal alloys both with and without turbulence-inducing structural features for contacting said alloys with fuel prior to combustion. Prior devices utilizing the compositions of matter of the present invention are improved by virtue of the simple usage of the present compositions of matter whether in the form of the shot 18 or as solid bars, tubular elements, etc.

Although the invention has been described explicitly in terms of particularly preferred compositions of matter, methods for making the compositions of matter and particular devices capable of utilizing the present compositions of matter to treat fuel prior to combustion for the purposes of improving combustion efficiency of the fuel, it is to be understood that the invention can be practiced other than as explicitly described hereinabove, the scope of the invention being defined solely by the recitations of the appended claims.

What is claimed is:

1. A method of operating an internal combustion engine or fuel combustion apparatus having a fuel line joining the engine or apparatus with a source of fuel supplied to the engine or apparatus, comprising the step of contacting the fuel prior to combustion with a microcrystalline alloy comprised of a major portion of silver, an effective amount of at least one platinum group metal and an effective amount of at least one rare earth and including isotopes thereof.

2. The method of claim 1 wherein the alloy comprises silver in a weight percent of between 60% and 90%; at least one platinum group metal selected from the group consisting of platinum, palladium, rhodium, osmium, ruthenium and iridium and isotopes thereof and present in a weight percent of less than 10%; and at least one rare earth selected from the group consisting of lanthanum, cerium, praseodymium, samarium, ytterbium, yttrium, neodymium, gadolinium, thorium and dysprosium and isotopes thereof.

3. The method of claim 1 wherein the alloy further comprises gold.

4. The method of claim 2 wherein the alloy further comprises gold in a weight percent of less than 10%.

5. The method of claim 1 wherein the alloy is in the form of metal mossy having substantial surface area.

6. The method of claim 2 wherein the alloy is in the form of metal mossy having substantial surface area.

7. The method of claim 3 wherein the alloy is in the form of metal mossy having substantial surface area.

8. The method of claim 4 wherein the alloy is in the form of metal mossy having substantial surface area.

9. The method of claim 1 wherein the fuel is a hydrocarbon fuel.

10. The method of claim 1 and further comprising the step of inducing turbulence in the fuel contacting the alloy.

11. Apparatus disposed in a fuel line between . an internal combustion engine or a fuel combustion apparatus and a source of fuel to be burned therein, comprising means disposed in the fuel line for contacting the fuel prior to combustion with a microcrystalline alloy comprised of a major portion of silver, at least one platinum group metal and at least one rare earth and including isotopes thereof.

12. The apparatus of claim 11 wherein the alloy comprises silver in a weight percent of between 60% and 90%; at least one platinum group metal selected from the group consisting of platinum, palladium, rhodium, osmium, ruthenium and iridium and isotopes thereof and present in a weight percent of less than 10%; and at least one rare earth selected from the group consisting of lanthanum, cerium, praseodymium, samarium, ytterbium, yttrium, neodymium, gadolinium, thorium and dysprosium and isotopes thereof.

13. The apparatus of claim 11 wherein the alloy further comprises gold.

14. The apparatus of claim 12 wherein the alloy further comprises gold in a weight percent of less than 10%.

15. The apparatus of claim 11 wherein the alloy is in the form of metal mossy having substantial surface area.

16. The apparatus of claim 11 wherein the fuel is a hydrocarbon fuel.

17. Compositions of matter comprising a complex microcrystalline metal alloy comprised of a major portion of silver, at least one platinum group metal, at least one rare earth including isotopes thereof and gold.

18. The compositions of matter of claim 17 wherein the alloy comprises silver in a weight percent of between 60% and 90%; at least one platinum group metal selected from the group consisting of platinum, palladium, rhodium, osmium, ruthenium and iridium and isotopes thereof and present in a weight percent of less than 10%; and at least one rare earth selected from the group consisting of lanthanum, cerium, praseodymium, samarium, ytterbium, yttrium, neodymium, gadolinium, thorium and dysprosium and isotopes thereof.

19. The compositions of matter of claim 18 wherein the alloy further comprises gold in a weight percent of less than 10%.

* * * * *